United States Patent [19]

Ledwitz

[11] Patent Number: 4,852,202

[45] Date of Patent: Aug. 1, 1989

[54] TOOTHBRUSH WITH ANGLED BRISTLES

[76] Inventor: Kenenth W. Ledwitz, 824G Main St., Belleville, N.J. 07109

[21] Appl. No.: 222,203

[22] Filed: Jul. 21, 1988

[51] Int. Cl.[4] ..... A46B 9/04

[52] U.S. Cl. ..... 15/167.1; 15/DIG. 5; 15/DIG. 6

[58] Field of Search ..... 15/167.1, 167.2, 106, 15/110, DIG. 5, DIG. 6

[56] References Cited

U.S. PATENT DOCUMENTS

| | | | |
|---|---|---|---|
| 2,274,042 | 2/1942 | Cosby | 15/167.1 |
| 3,359,588 | 12/1967 | Kobler | 15/167.1 |
| 3,722,020 | 3/1973 | Hills | 15/167.1 |

*Primary Examiner*—Peter Feldman

*Attorney, Agent, or Firm*—Rohm & Monsanto

[57] ABSTRACT

A toothbrush is provided with a plurality of bristles arranged perpendicular to the working surface of the brush head, and a further plurality of bristles arranged at an angle with respect thereto of preferably 45°. The angled bristles extend from a working platform which is installed on the working surface of the brush head and which provides a further working surface. Such angled bristles promote cleansing of the gingival margin and the gingival sulcus, without requiring the toothbrush head to be canted during brushing. In a highly advantageous embodiment of the invention, further angled bristles are provided extending from a region near the juncture of the working platform and the first working surface of the brush head. In addition, soft perpendicular bristles are arranged to extend from the further working surface.

6 Claims, 2 Drawing Sheets

TOOTHBRUSH WITH ANGLED BRISTLES

BACKGROUND OF THE INVENTION

This invention relates generally to toothbrushes for human beings, and more particularly, to a toothbrush arrangement having multiple sets of bristles arranged at predetermined angles with respect to one another whereby cleaning of the gingival sulcus is enhanced.

It is now recognized by most dental professionals that, during brushing, the bristles of the toothbrush should be oriented so that the bristles are directed toward the gingival margin. The cleansing of the gum is optimized when the bristles of the toothbrush are at an angle of approximately 45° relative to the gum. However, the majority of persons orient the toothbrush so that it is substantially perpendicular to the teeth and gum. There is, therefore, a need for a toothbrush arrangement which enhances cleansing of the gum, particularly the gingival sulcus, without relying on canting of the toothbrush by the user.

It is, therefore, an object of this invention to provide a simple and economical toothbrush system which improves cleansing of the gingival margin.

It is another object of this invention to provide a toothbrush arrangement which enhances cleansing of the gum without requiring canting thereof by the user.

It is also an object of this invention to provide toothbrush system which enables gingival stimulation and cleansing.

It is a further object of this invention to provide a simple and economical toothbrush arrangement which improves cleansing of the gingival sulcus.

SUMMARY OF THE INVENTION

The foregoing and other objects are achieved by this invention which provides a toothbrush arrangement for brushing the teeth of a human being. In accordance with the invention, the toothbrush is provided with a head portion which provides a working end for the toothbrush, and a handle portion which is coupled to the head portion for facilitating gripping and manipulation of the head portion during brushing of the teeth. The head portion is provided with a first base portion which has a first base working surface of a predetermined length which is measured substantially coaxially with the handle portion, and a predetermined width which is measured in a direction transverse thereto. A second base portion is provided on the working surface. The second base portion has smaller length and width dimensions than the working surface of the first base portion. Additionally, the second base portion provides a second base working surface. A first plurality of bristles is coupled to the first base portion, the bristles thereof extending from the first base portion at a first predetermined angle with respect to the first base working surface. In one embodiment of the invention, this first predetermined angle is approximately 90°. A second plurality of bristles is coupled to the second base portion, the bristles extending therefrom at a second predetermined angle with respect to the first base working surface. In a further, specific embodiment of the invention, the second predetermined angle is less than 90°, and the second plurality of bristles is directed generally toward the first plurality of bristles.

In a specific illustrative embodiment of the invention, the second predetermined angle is approximately 45°. Thus, when the toothbrush is held substantially perpendicular with respect to the teeth, this second plurality of bristles is arranged at an optimum angle to cleanse the gingival margin and the gingival sulcus.

In a further embodiment of the invention, a third plurality of bristles is provided, extending from the vicinity of juncture between the first and second base portions. This third plurality of bristles extends from the head portion at a third predetermined angle with respect to the first base working surface, and at an angle which is intermediate of the first and second predetermined angles. Preferably, the first, second, and third pluralities of bristles are oriented substantially so as to converge at a region distal from the working surfaces. In such an embodiment, the first plurality of bristles is arranged as a row of bristles which is generally parallel to the length dimension of the head portion of the toothbrush.

In accordance with a still further aspect of the invention, a fourth plurality of bristles is arranged to extend from a topmost portion of the second base portion. This fourth plurality of bristles is arranged to extend substantially parallel to the first plurality of bristles. In a preferred embodiment, the fourth plurality of bristles is essentially perpendicular with respect to the first base working surface. Moreover, since the fourth plurality of bristles is shorter than the first plurality of bristles, these bristles may be made softer so as to achieve substantially uniform deflection under load.

In accordance with a further aspect of the invention, a toothbrush of the type having a working surface from which extend a plurality of bristles in a direction substantially perpendicular from the working surface is provided with a working platform installed on the working surface for providing a further working surface. Additional, or further, bristles extend from the further working platform at an angle which is other than perpendicular with respect to the working surface. The further bristles are directed toward the bristles which extend from the working surface.

In a specific illustrative embodiment of this further aspect of the invention, a plurality of soft bristles are arranged to extend from the further working platform, and at an angle which is substantially perpendicular with respect to the working surface. These soft bristles, as indicated above, have a firmness characteristic which is softer than that of the plurality of bristles which extend from the working surface.

In a preferred embodiment, the plurality of bristles which extend from the working surface and the further bristles which extend from the working platform are directed substantially to converge with each other at a region which is distal from the working surface. This aspect of the invention can be achieved economically, particularly in embodiments where the working platform is formed integrally with the working surface.

BRIEF DESCRIPTION OF THE DRAWING

Comprehension of the invention is facilitated by reading the following detailed description, in conjunction with the annexed drawing, in which.

DETAILED DESCRIPTION

Figure 1:
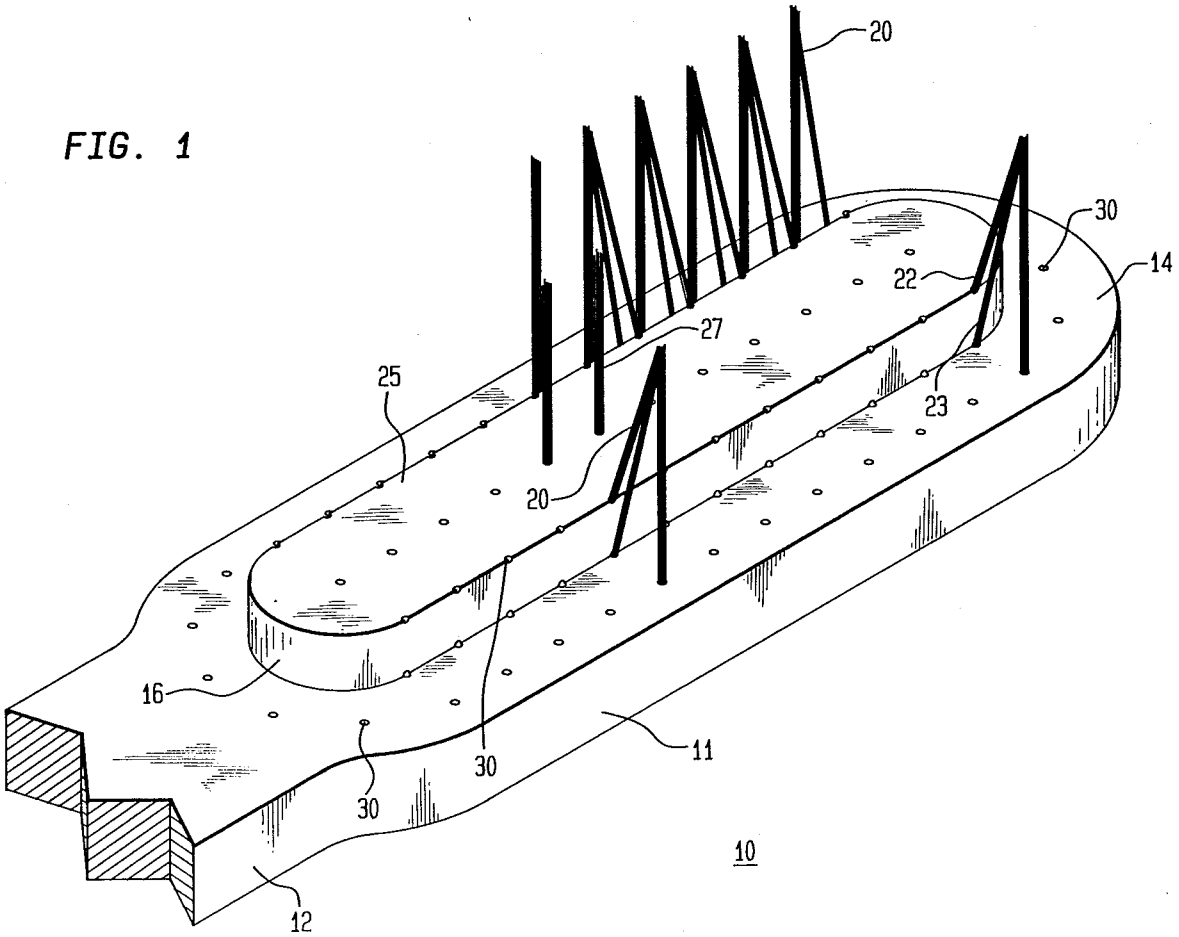
FIG. 1 is a partially fragmented isometric representation of a specific illustrative embodiment of the invention wherein the majority of the bristles have been removed for the sake of clarity of the depiction.

FIG. 1 is a fragmented isometric representation of a toothbrush 10 having a head portion 11 and a handle portion 12. Head portion 11 is provided with a working surface 14 on which is installed a platform member 16. In certain embodiments, platform member 16 may be formed integrally with head portion 11.

A first plurality of bristles 20 is arranged to extend from working surface 14. As shown, bristles 20 extend away from working surface 14 and are substantially perpendicular thereto. A second plurality of bristles 22 is arranged to extend from platform member 16 at an angle which is less than 90° with respect to the working surface. A third plurality of bristles extends from a region near the juncture of working surface 14 and platform member 16, and extend away from head portion 11 at an angle which is intermediate of the first and second pluralities of bristles. The angular relationships between the first, second, and third pluralities of bristles will be discussed hereinbelow with respect to FIG. 2.

Referring once again to FIG. 1, platform member 16 provides, in a region distal from working surface 14, a further working surface 25. In this specific illustrative embodiment of the invention, a fourth plurality of bristles 27 is arranged to extend away from the further working surface and substantially perpendicular thereto.

Most of the bristles of toothbrush 10 have been removed in FIG. 1 for the purpose of clarity of the depiction. However, a plurality of bristles can be installed at each of bristle positions 30. It is to be understood that neither the position nor the number of bristle positions 30 is limited to the representation of FIG. 1. For example, working surface 14 and further working surface 25 may each contain a plurality of rows of bristle positions, and such replication of the bristle positions so as to form multiple rows of bristles is within the scope of the present invention.

Figure 2:
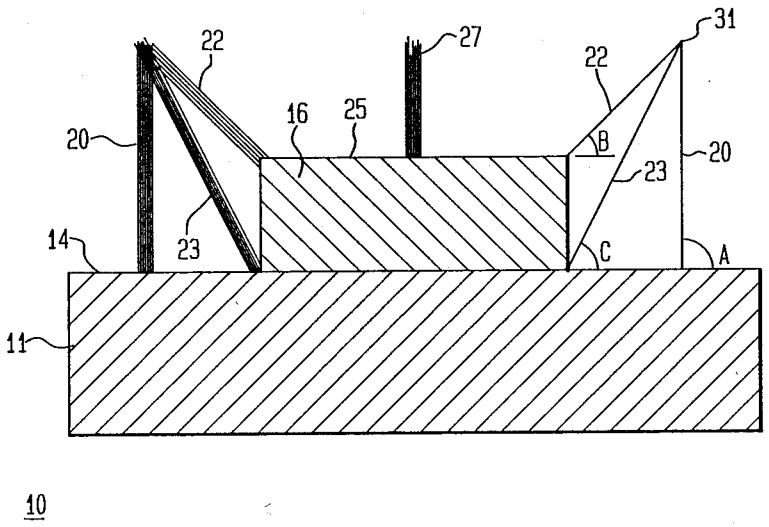
FIG. 2 is a schematic, cross-sectional representation of an embodiment of the invention illustrating the angular relationships between the bristle sets.

FIG. 2 is a cross-sectional schematic representation of an embodiment of the invention. Elements of structure which bear analogous correspondence to those of FIG. 1 are similarly designated. First plurality of bristles 20 extend from working surface 14 of head portion 11 at an angle A. As previously indicated with respect to FIG. 1, angle A in this embodiment, is approximately 90°, whereby bristles 20 are perpendicular to the working surface.

Second plurality of bristles 22 extend outward from the vicinity of an edge of platform member 16, and in this embodiment, near further working surface 25. Bristles 22 are arranged at an angle B with respect to the working surface. In this embodiment, angle B may be approximately 45°, whereby when the toothbrush is held so that bristles 20 are substantially perpendicular to the teeth being brushed, bristles 22 are oriented to produce optimal cleansing and stimulation of the gingival margin.

Third plurality of bristles 23 extends from head portion 11 in the vicinity of the juncture between working surface 14 and platform member 16. Bristles 23 extend outward at an angle C which is intermediate of angles A and B. In this specific illustrative embodiment of the invention, bristles 20, 23, and 22 all are arranged to converge in a region 31 which is distal from working surface 14. It is to be understood, however, that the bristles need not be oriented to achieve such convergence to remain within the scope of the present invention.

Fourth plurality of bristles 27 is arranged to extend from further working surface 25 of platform member 16, and in this embodiment, substantially parallel to bristles 20. Other angles can be used in the orientation of bristles 27. In addition, since bristles 27 are somewhat shorter than bristles 20, bristles 27 may be provided with a softer firmness characteristic than the other bristles so that deflection under load is comparable to the other bristles.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A toothbrush for brushing the teeth of a human being, the toothbrush comprising:

a head portion for providing a working end of the toothbrush;

a handle portion coupled to said head portion for facilitating gripping and manipulation of said head portion of the toothbrush by the human being;

a first base portion on said head portion of the toothbrush, said first base portion having a first base working surface having a predetermined length measured substantially coaxially with said handle portion and a predetermined width measured transverse thereto;

a second base portion on said working surface of said first base portion, said second base portion having a predetermined width measurement which is smaller than that of said working surface of said first base portion, and a second base working surface;

first bristle means coupled to said first base portion for performing the brushing of the teeth, said first bristle means extending so as to terminate within a predetermined region distal from said first base portion at a first angle of approximately 90° with respect to said first base working surface;

second bristle means coupled to said second base portion for performing the brushing of the teeth, said second bristle means extending from said second base portion at a second predetermined angle of approximately 45° with respect to said first base working surface, said second bristle means being directed toward said first bristle means so as to terminate within said predetermined region where said first bristle means terminates; and third bristle means coupled to said head portion in the vicinity of a juncture between said first and second base portions extending from said head portion at an angle with respect to said first base working surface which is intermediate of said first and second predetermined angles, wherein said second and third bristle means are arranged to extend substantially toward said distalmost portion of said first bristle means and terminate within said predetermined region where said first bristle means terminates.

2. The toothbrush of claim 1 wherein there is further provided fourth bristle means extending from a topmost portion of said second base portion, said fourth bristle means being substantially parallel to said first bristle means.

3. The toothbrush of claim 2 wherein said fourth bristle means has a softer firmness characteristic than said first bristle means.

4. A toothbrush of the type having a working surface from which extends a plurality of bristles in a direction substantially perpendicular from the working surface, the bristles terminating within a predetermined region distal from the working surface, the toothbrush comprising:

a working platform installed on the working surface for providing a further working surface; and further bristles extending from said further working platform at an angle other than perpendicular with respect to the working surface and directed so as to terminate substantially in the region of the termination of the bristles extending from the working surface.

5. The toothbrush of claim 4 wherein there is further provided a plurality of soft bristles extending from said further working platform at an angle substantially perpendicular with respect to the working surface and having a firmness characteristic which is softer than that of the plurality of bristles extending from the working surface.

6. The toothbrush of claim 4 wherein said working platform is formed integrally with the working surface.

* * * * *